US008665095B2

(12) United States Patent
Yang

(10) Patent No.: US 8,665,095 B2
(45) Date of Patent: Mar. 4, 2014

(54) EAS TAG FOR IRREGULAR OBJECTS

(75) Inventor: Xiao Hui Yang, Los Altos, CA (US)

(73) Assignee: WG Security Products, Campbell, CA (US)

( * ) Notice: Subject to any disclaimer, the term of this patent is extended or adjusted under 35 U.S.C. 154(b) by 740 days.

(21) Appl. No.: 12/813,393

(22) Filed: Jun. 10, 2010

(65) Prior Publication Data

US 2010/0315237 A1 Dec. 16, 2010

Related U.S. Application Data

(60) Provisional application No. 61/185,787, filed on Jun. 10, 2009.

(51) Int. Cl.
*G08B 13/14* (2006.01)

(52) U.S. Cl.
USPC ..... 340/572.8; 340/572.9; 340/568.1; 340/572.1

(58) Field of Classification Search
None
See application file for complete search history.

(56) References Cited

U.S. PATENT DOCUMENTS 5,524,463 A * 6/1996 Schenkel et al. ..... 70/57.1
5,535,606 A * 7/1996 Nguyen et al. ..... 70/57.1
6,052,876 A * 4/2000 Hogan et al. ..... 24/704.1
6,853,304 B2 * 2/2005 Reisman et al. ..... 340/573.4
6,958,698 B2 * 10/2005 Maloney ..... 340/572.8
7,129,841 B2 * 10/2006 Feibelman ..... 340/568.1
7,388,484 B2 * 6/2008 Hsu ..... 340/539.31
7,474,209 B2 * 1/2009 Marsilio et al. ..... 340/568.1
7,724,146 B2 * 5/2010 Nguyen et al. ..... 340/572.8
7,916,020 B2 * 3/2011 Seidel ..... 340/568.1
8,044,806 B2 * 10/2011 Sayegh ..... 340/572.9
8,144,014 B1 * 3/2012 Yang ..... 340/572.1
8,269,632 B2 * 9/2012 Hesch et al. ..... 340/572.8
2005/0093704 A1 * 5/2005 Feibelman ..... 340/572.9
2009/0224918 A1 * 9/2009 Copeland ..... 340/572.1
2010/0315239 A1 * 12/2010 Yang ..... 340/572.9
2011/0115632 A1 * 5/2011 Yang ..... 340/572.8
2011/0260594 A1 * 10/2011 Yang ..... 312/297

* cited by examiner

*Primary Examiner* — Julie Lieu
(74) *Attorney, Agent, or Firm* — Robert R. Waters; Brian W. Foxworthy; Waters Law Group, PLLC

(57) ABSTRACT

An EAS tag has an adjustable retention cable for attaching the tag to an irregularly shaped object. A clutch mechanism prevents the retention cable from being released without authorization. The tag may carry electronic components including a circuit board, microprocessor, battery, audible alarm generator, light emitting diode, anti-tamper switches, infrared communication port, and other communication electronics. The tag may also carry an EAS element such as a harmonic element or acousto-magnetic element. An EAS system with which the EAS tag is associated may communicate with the EAS tag and obtain information, arm, disarm, encode information, and otherwise reprogram the tag via the infrared communication port or other means.

18 Claims, 10 Drawing Sheets

EAS TAG FOR IRREGULAR OBJECTS

CROSS REFERENCE TO RELATED APPLICATIONS

This application claims priority to U.S. Provisional Application 61/185,787 filed on Jun. 10, 2009. The entire disclosures contained in U.S. Provisional Application 61/185,787, including the attachments thereto, are incorporated herein by reference.

FIELD OF INVENTION

The present application is generally related to an electronic article surveillance (EAS) tag, and more specifically, an EAS tag that can be attached to irregularly shaped objects. Also, the tag of the present application may used with various electronic article surveillance (EAS) systems, including for example, an EAS system utilizing tags and deactivators featuring infrared communication for deactivation and alarming, and featuring dynamic time-based passcode modification, and other tamper resistant features.

MOTIVATION OF THE INVENTOR

A. Description of the State of the Art

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of the store personnel at the checkout register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc.

In order to make an EAS system effective, one must consider how to make the EAS tags tamper resistant. This is an on-going effort, because over time, thieves become more clever in learning how to tamper with an EAS tag to defeat it. The retailer (and the tag manufacturer) must consider how to detect and prevent tampering with the tags. The particular construction of a tag will determine how tampering is detected.

An assortment of attachment mechanisms are available in the prior art. One of the more common and more successful attachment mechanisms is an EAS hard tag, consisting of a tack which is used to physically pin the protected article to the EAS tag base. The tag base is usually constructed of a hard and durable plastic and is generally in the neighborhood of three inches long. The tag serves as a housing for an electronic signal generation means secured within the housing, and which is designed to be immune to tampering. A cap on the tack keeps the tag attached to the article.

Another common and successful method of attaching tags, or transponders, is a lanyard. One end of the lanyard is fixed in the transponder and the other end is capable of being inserted into an aperture in the transponder where it can be retained by the transponder. The lanyard can pass through an aperture on the article to be protected or may be placed around an article in a position where it cannot be simply slid off the article. The lanyard is typically constructed of material that is very difficult to break or cut, but yet, is easy to bend into place.

A common device for releasably retaining both tack shafts and lanyard ends is a ball clutch mechanism. The ball clutch mechanism may be constructed to release the retained item after application of a strong magnetic force. Other clips and clamps may also be used. Other types of tags may employ vials of ink, which may break if the tag is physically bent, thereby destroying the benefit of the theft attempt.

B. The Need for Improvement

While tack and lanyard tags are effective and successful in certain applications, there continues to be a need for tags that can be attached to irregularly shaped objects. Tack attached tags are limited to being attached to objects that can be pierced with a tag without damage. Lanyard tags are limited to objects that provide a good location to employ the lanyard and are generally of a fixed length. The class of objects not amenable to tack or lanyard tags of fixed length is substantial. The EAS tag or device of the present application can be used with objects having irregular shapes while still employing locking technology available in conventional systems. Also the EAS tag of the present application can be made to be compatible with various EAS systems and other antitheft systems.

Although EAS systems have been used effectively for many years, the retail landscape has been challenged by thieves that are becoming ever more sophisticated. For example, a sophisticated thief may learn how to defeat a ball clutch mechanism, or other releasable one-way clutch, by carrying into a store a magnet similar to the magnet used to remove the tags at the check-out counter. To prevent theft by using an unauthorized magnet, various techniques and systems have been developed. The tag of the present application is adaptable to incorporate these techniques and to work in these systems.

For example, a sophisticated thief can use devices designed to determine the algorithm of the deactivation devices or tags in order to jam the operation of the tag. A sophisticated thief may have a means for determining passcodes for the system by espionage or by breaching electronic security codes. Furthermore, a large amount of theft (or shrinkage) results from an "inside job" by dishonest employees, who may have access to passcodes and the like. Therefore, EAS systems that are dynamic such that key passcode coding and the like may be quickly or even randomly changed have been developed. Thus, a need has been demonstrated for an EAS tag that can attach to irregularly shaped objects and also accommodate sophisticated EAS systems.

SUMMARY

This application generally discloses an electronic article surveillance tag, or marker, capable of attaching to irregularly shaped objects. The tag employs a retention cable capable of passing around the irregularly shaped objects and a releasable one-way clutch to keep the retention cable tight about the object. The retention cable passes through the releasable one-way clutch. In some embodiments a releasable blocking mechanism prevents the release of the one-way clutch. In some embodiments, the retention cable is infinitely adjustable from its full extension to its tightest retraction, while in other embodiments, the retention cable may be adjusted in discrete increments within that range.

At least one embodiment of the tag may be employed with a system utilizing infrared technology to protect retail merchandise. The system utilizes infrared technology to communicate between central elements of the system and individual tags. The system can employ passcodes to securely authorize detachment of the tags and, in some embodiments, the system utilizes infrared technology to affect a system in which time-based passcode coding may be easily changed to create greater security and less vulnerability for the system to be compromised. The tag is capable of carrying the electronics necessary to operate in such a system.

In one embodiment, an electronic article surveillance system comprises at least one tag. Each tag comprises an accurate clock generator, a microprocessor, infrared communication capabilities, and machine readable instructions encoded for performing an algorithm for generating multiple passcodes. At a specified time, each active tag possesses a passcode. In at least one embodiment, all of the tags in a given location or vicinity have the same changeable passcode at any given time. The EAS system is further characterized by at least one base station, each base station comprising an accurate clock generator, a processor, machine readable instructions encoded for performing an algorithm generating multiple passcodes. The base station further includes infrared communication capabilities with an infrared communication path between each tag and each base station, the path enabling interchange of information between each tag and each base station. Each tag replaces the passcode at a specified interval, or at a specified point in time.

In another embodiment, an electronic article surveillance system comprises: at least one tag, each tag comprising an accurate clock generator, a microprocessor, infrared communication means, and machine readable instructions encoded for performing an algorithm for generating multiple passcodes, and wherein at a specific time, each active tag possesses a passcode; at least one base station, each base station comprising an accurate clock generator, a processor, and machine readable instructions encoded for performing an algorithm for generating multiple passcodes; at least one remote for remotely detecting information and programming additional information; an infrared communication path between each tag, each base station and each remote, the path enabling interchange of information between each tag and each base station; wherein each tag replaces the passcode at a specified time.

In other embodiments, the EAS tags and other elements of the system may use radio frequency communication to transmit information between them. The EAS tags of those embodiments are capable of containing the necessary electronic components to communicate with radio frequency communications. As with embodiments discussed above the information may include security passcodes, alarms, etc.

A person of ordinary skill in the art would understand how to incorporate the improvements described herein into a conventional EAS system.

BRIEF DESCRIPTION OF THE DRAWINGS

Additional utility and features of the invention will become more fully apparent to those skilled in the art by reference to the following drawings, which illustrate some of the primary features of preferred embodiments.

DESCRIPTION OF THE EMBODIMENT(S)

Figure 1:
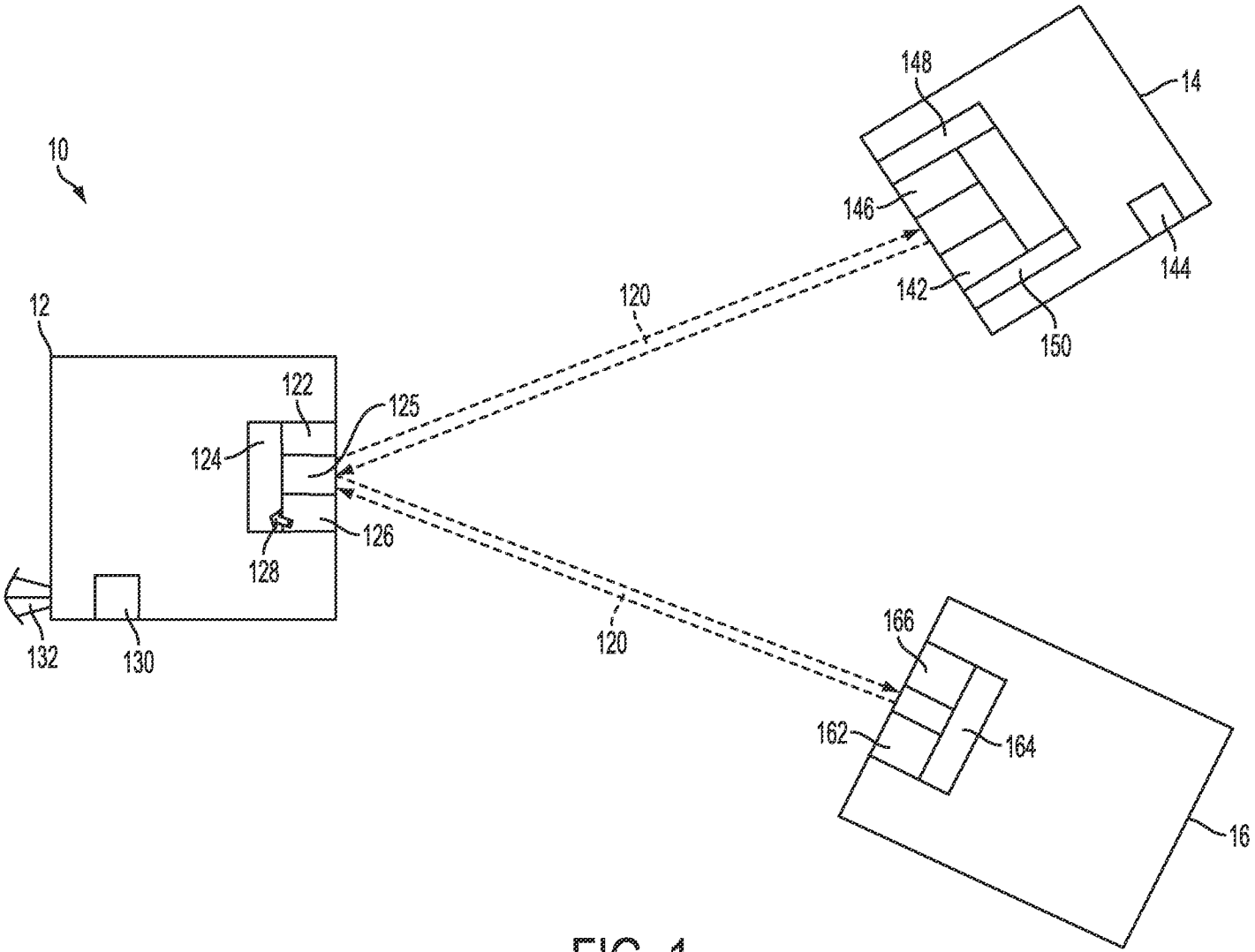
FIG. 1 is a block diagram showing the primary components of a system employing communications tags, in this case, infrared communication.

Referring now to FIG. 1, one possible electronic article surveillance (EAS) system 10 utilizing EAS tags is disclosed, the system 10 generally comprising at least one tag 12 attached to an article "A", at least one base station 14, and at least one remote 16. The system 10 comprises a means for establishing an infrared (IR) communication path 120 shared between each tag 12 and each base station 14 and each remote station 16, an accurate clock generator 122, microprocessor 124, an algorithm 126 for passcode generation, infrared sensor 125 and a means for attaching tag 12 to the article. Each tag 12 is automatically assigned a default passcode 128 at the time of manufacture.

In EAS systems, each tag 12 is generally capable of generating a signal 130 detectable by an interrogation unit. While many commercially available EAS systems operate on a frequency of 58 kHz, other arrangements are also possible, and the present invention is not limited to any particular frequency. This signal may be generated by any of the known methods, such as by means of a resonator or a ferrite coil located in the tag or transponder, typical of conventional electronic article surveillance markers.

Figure 2:
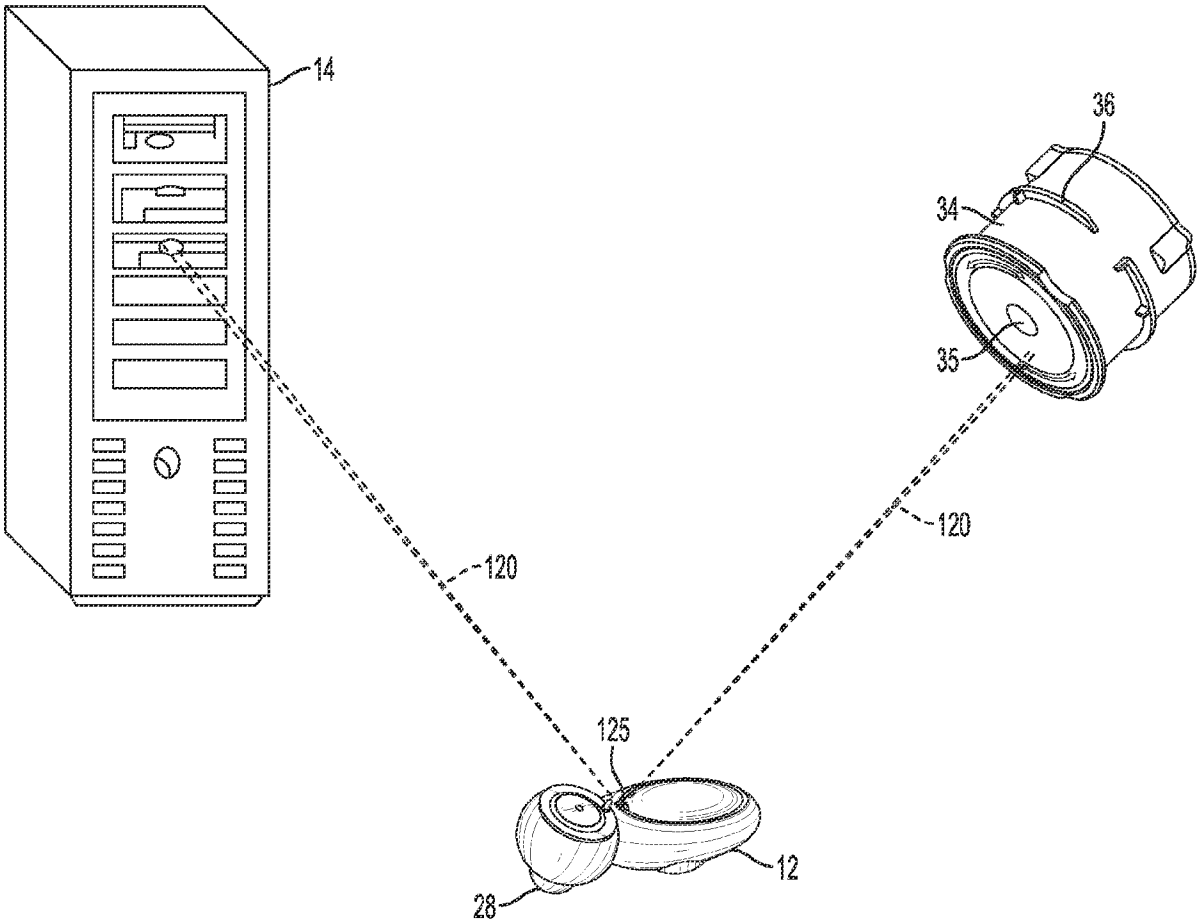
FIG. 2 is a diagram identifying the three primary components that communicate with each other, in the case of FIG. 1, via infrared signaling.

In the system shown by FIG. 1 and FIG. 2, each tag 12 comprises a self-contained alarm 132 that may be actuated by: (a) a signal generated by an EAS antenna system at the retail exit in the event of a shoplifting event; (b) tampering of the tag 12, or by (c) being released from the article to which it is attached by a detacher that is not compatible with the IR system. Additionally, the EAS antenna system that generates the interrogation zone can alarm as well, as per conventional use in EAS systems.

Each base station 14 may comprise an accurate clock generator 142, microprocessor 144, algorithm 146 for passcode generation, tag erase function 148, USB port for function configuration 150, and the capability to communicate via infrared communication path 120. In some systems, base station 14 can run software capable of performing database functions for tracking tag passcodes, operating a detacher and configuring tags 12 and remotes 16, and can generally operate at the level of a typical PC running a specialized application.

Each remote 16 comprises an accurate clock generator 162, microprocessor 164, and algorithm 166 for passcode generation.

In addition to infrared communication between the tags and the base station 14 and remote station(s) 16, it is important that the system facilitates communication between the tags 10 and a detacher unit 34. This is shown more fully in FIG. 2 which shows IR communication means 120 communicating between tag 10, detacher 34 and base station 14. In this diagram, the base station is shown as being a stand-alone computer, although other arrangements for a base station 14 are also possible. In some applications of the system, the base station 14 and detacher 34 may be integrally incorporated into one piece of equipment such as to utilize the same clock generator 142, algorithm 146 for passcode generation and tag erase function 148. Likewise, in other embodiments, the detacher unit 34 may be separate from the base station 14 in which it will be necessary that the detacher unit 34 have its own synchronized clock, passcode generator algorithm and tag erase function.

In some systems, the IR communication means 120 provides communication between each tag 12 and each base station 14, remote 16, and detacher 34 respectively. Communication means 120 enables the base station 14 or remote 16 or detacher 34 to read information from and communicate and/or write information to each tag 12. The path 120 enables each tag 12, base station 14, remote 16 and detacher 34 to effectively communicate concerning the accurate clock generator 122 and its cooperative relationship with the passcode 128 and algorithm 126 generating the passcode 128. In this manner, the path 120 facilitates the exchange of information important in activating, resetting or deactivating each tag 12.

In some systems, the accurate clock generator 122 of tag 12 operates in synchronicity with one or all of the accurate clock generators 142 (associated with base station 14) and 144 (associated with remote 16), respectively. The generators 122, 142 and/or 162 cooperatively synchronize so that each component is accurately detecting the same clock time. In the event that the detacher has its own accurate clock generator separate from the base station, the synchronization feature will apply to that clock as well. The passcode 128 of each tag 12 is periodically altered or changed by the algorithm 126 in accordance with a determined interval of time (e.g. 30 minute intervals). Thus, each tag 12 may be programmed so that the algorithm 126 alters or changes the passcode 128 every 30 minutes, for example, thereby minimizing the opportunities for theft of an article through passcode manipulation or bypass. As such, the accurate clock generators 122, 142, 162 and any detacher clock generator enable the base station 14, remote 16 and detacher 34 to detect the passcode 128 of each tag 12, and if necessary or desired, alter or change the passcode 128 or completely erase the passcode at the point of interaction, temporarily disabling the tag 12.

Depending on the system, each base station 14 may provide at least two desirable functions. First, the base station 14 may permit resetting of the tag 12 parameters existing at the moment, including parameters previously input for the accurate clock generator, microprocessor, and passcode. The passcode may be altered or changed to a passcode or series of codes assigned by the store or business utilizing the system. Secondly, the base station 14 may be utilized to confirm tag parameters, such as status or passcode/code(s).

Figure 3:
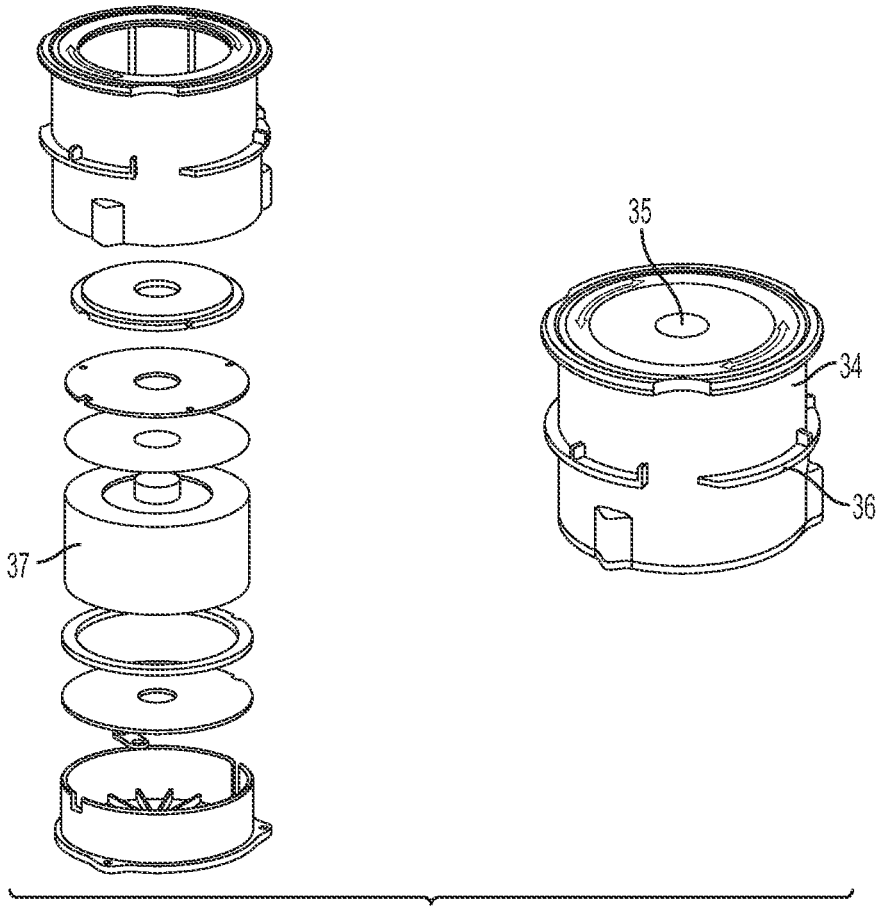
FIG. 3 is a detail drawing of a detacher module employing magnetic force and infrared communication.

FIG. 3 is a detail drawing of detacher module 34 for a system utilizing tags like the current invention. Detacher 34 serves the function of providing the means for removing tag 12 from the protected article at the checkout counter. In this system, detacher 34 features a communication port 35 whereby an infrared signal is generated such as to communicate with tag 12. Detacher 34 also features a strong magnet 37 which is needed to apply magnetic force to the tag 12 (as shown in FIG. 2), thereby serving to allow the tag 12 to be removed from the protected item. Accordingly, in order to release tag 12, both functions may be performed by detacher 34. The infrared sensor 35 of detacher 34 communicates with infrared sensor 125 of tag 12 (FIG. 2) in order to enable a successful deactivation. In addition, a magnetic force is applied to actually allow the removal of the tag. In this regard, the EAS system of the present invention is much more secure than conventional EAS systems in that two separate actions must be performed before a release can occur. This process prevents the scenario in which a thief is able to smuggle a large magnet into the store to remove tags from merchandise. If such tags are removed at a location away from the infrared communications path 120, the tag 12 will still self alarm.

Figure 4:
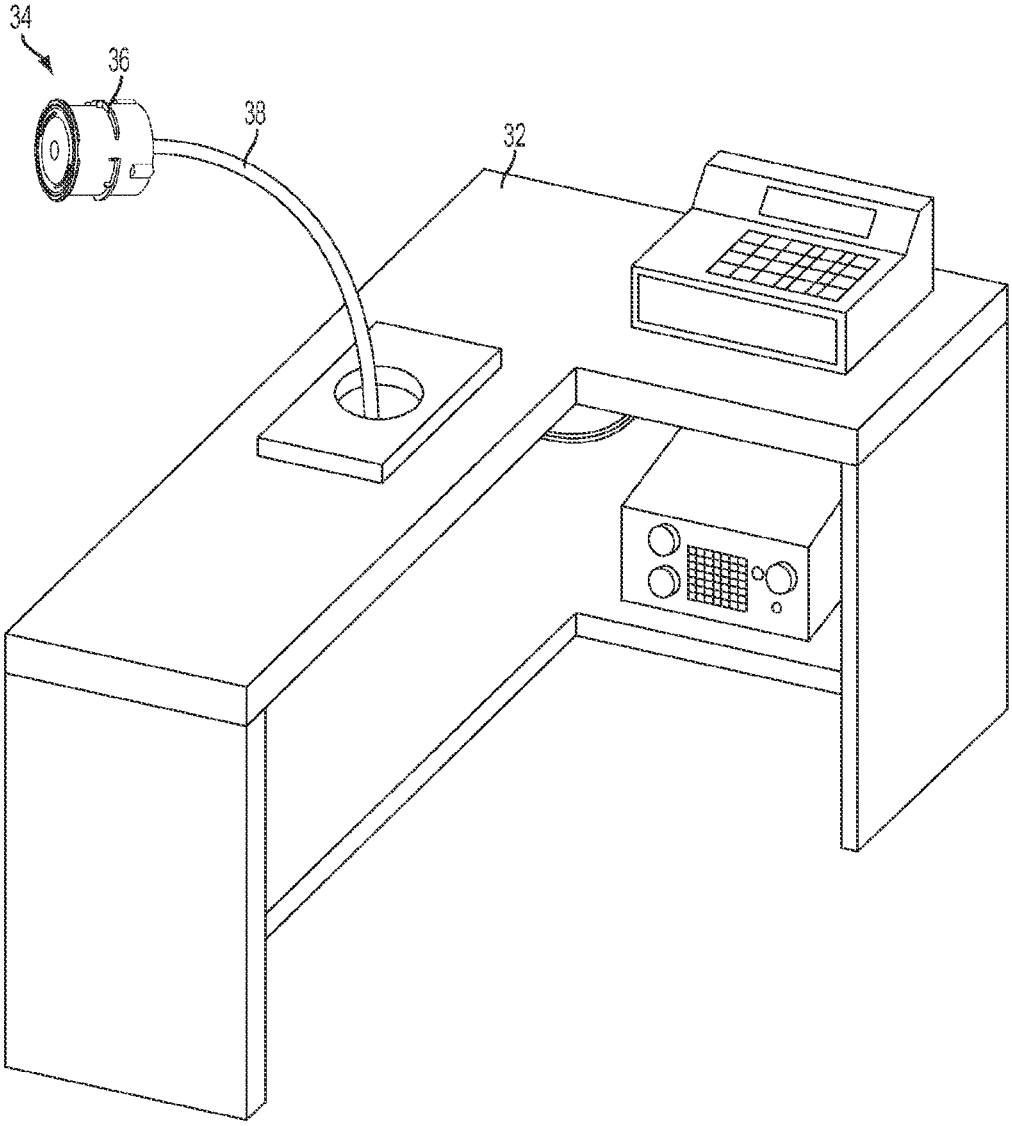
FIG. 4 is perspective view of a typical arrangement of a detacher module at a typical retail checkout counter.

Referring to FIG. 4, a magnetic detacher 34 is normally set into counter 32, but it also has the ability to be removed from its mounting to facilitate tag communication and removal of tags from articles that are too cumbersome to be placed on the counter top. The detacher 34 is connected via tether 38 to prevent it from being removed and carried away altogether from the counter 32. Detacher 34 will also feature communication with base station 14 that may take the form of hard wiring. (not shown in the drawings) The detacher 34 may also include a self-alarm that is actuated by removal from tether 38, such as if the tether is disconnected or severed in some manner.

The alarm 132 on board tag 12 may be independent of the alarm generated in response to tag 12 detection by the regular EAS antenna system within the respective interrogation zone. The sensitivity of the alarm 132 may be adjustable or preset, depending upon preference, so that attempted removal of the tag 12 from an article, or a separation of one or more of the components of the tag 12, actuates the alarm 132 at the point of tampering. Alternatively, the sensitivity may be adjustable or preset, depending upon preference, so that actual removal of the tag 12, or separation of one or more of the components of the tag 12, actuates the alarm 132 at the point of tampering. Under either circumstance or condition, if sufficient tampering or successful removal of the tag 12 is achieved, the alarm 132 may generate an alarm signal detectable by security personnel or assigned personnel. Various embodiments of tags of the present invention are programmable to incorporate the specific functions employed and required by various systems through infrared and radio communications.

Figure 5:
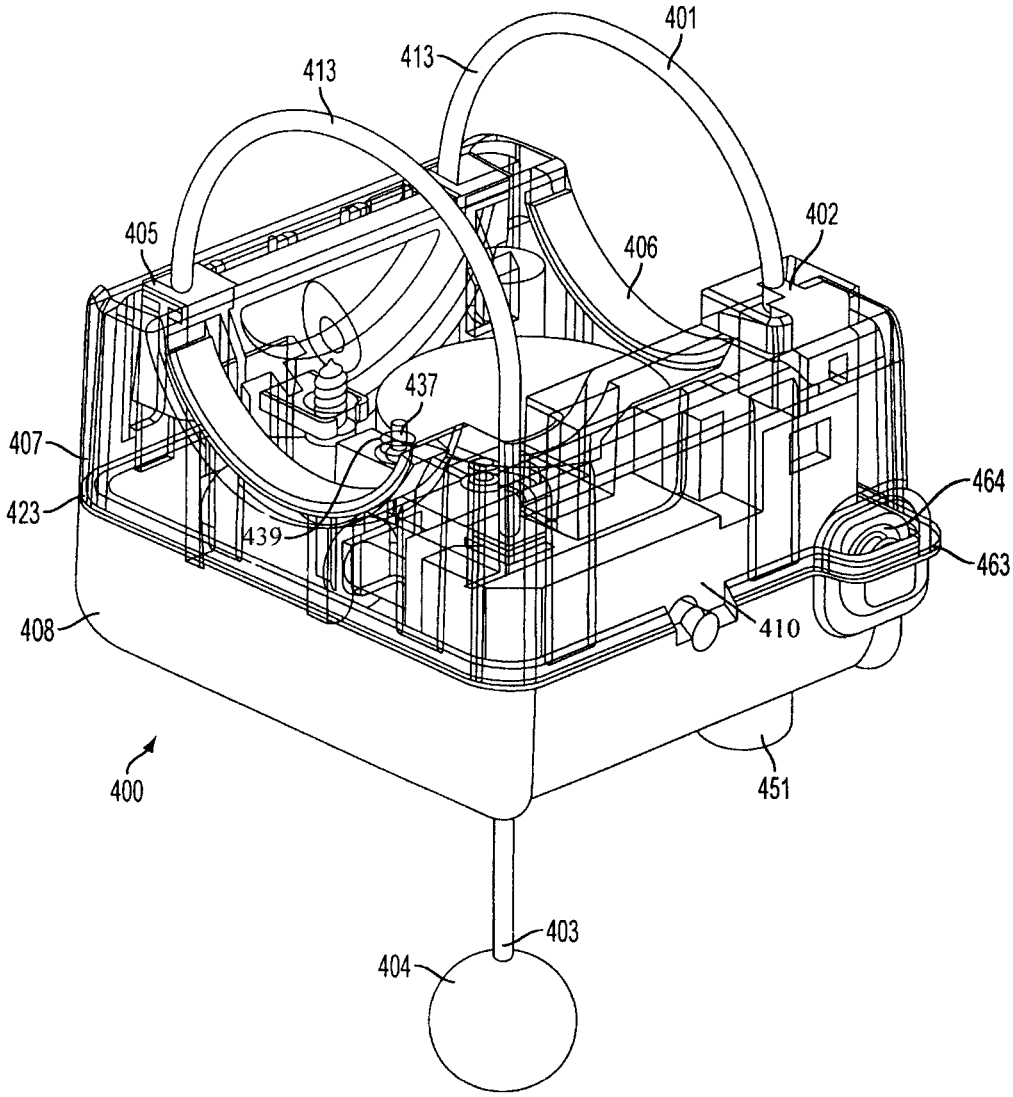
FIG. 5 is a perspective view of an EAS tag for irregular objects with the retention part of external shell shown transparent in wireframe.

Referring now to FIG. 5, EAS tag for irregular objects 400 can be seen. EAS tag for irregular objects 400 has a retention cable 401 having a fixed end 402 and a free, adjustable end 403 with a pull knob 404 on the adjustable end 403. Retention cable 401 is anchored at fixed end 402 in mechanical housing 410 and passes through looping anchor 405 back to mechanical housing 410 to adjustable end 403 which is free. The outermost body of EAS tag for irregular objects 400 is comprised of two halves of a housing shell 423, a retention half 407 of housing shell 423 and an electronics half 408 of the housing shell 423. The retention half 407 of housing shell 423 of EAS tag for irregular objects 400 provides the structure and anchoring of mechanical housing 410 and looping anchor 405. The electronics half 408 of housing shell 423 of EAS tag for irregular objects 400 holds the electronic elements of EAS tag for irregular objects 400.

Figure 6:
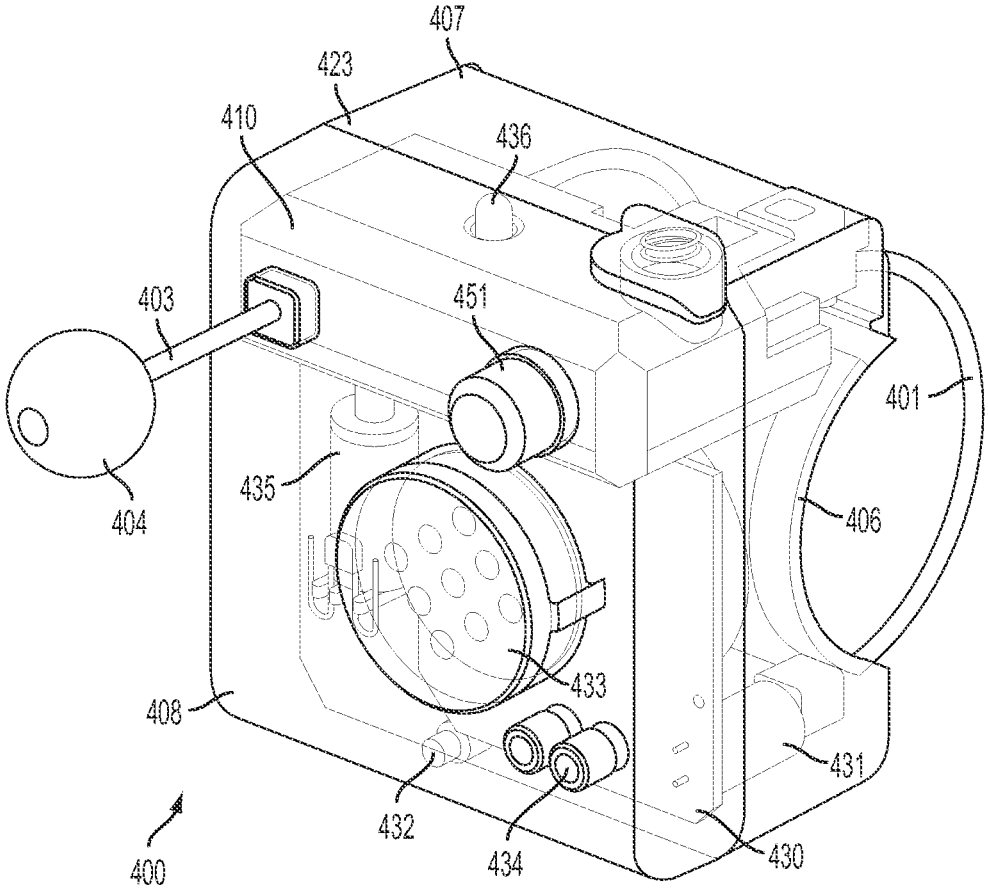
FIG. 6 is a perspective view of an EAS tag for irregular objects showing the position of electronic elements with the external shell of the EAS tag shown transparent.

Referring to FIG. 6, circuit board 430 and its elements may be seen within EAS tag for irregular objects 400. Active EAS tags usually require a power source. In the embodiment shown in FIG. 6, battery 431 provides power to circuit board 430 and its elements, including in some embodiments, a microprocessor. In addition to a microprocessor, circuit board 430 may have other electronic features, such as light emitting diode 432, onboard audible alarm generator 433, and infrared communication port 436 which, in the embodiment of FIG. 6, extends some distance from circuit board 430. Some embodiments of EAS tag for irregular objects 400 may have a passive EAS element 435. Some embodiments of EAS tag for irregular objects 400 will use infrared wavelength light as the communication median. Infrared communication port 436 provides the means for accomplishing this. Other embodiments of EAS tag for irregular objects 400 will use radio frequency signals as the communication median.

Many active EAS tags have the ability to produce an audible alarm. In the embodiment of EAS tag for irregular objects 400 shown in FIG. 6, audible alarm generator 433 provides this capability. If EAS tag for irregular objects 400 is removed from an object without authorization (as detected by anti-tamper switch 437 visible in FIG. 5 and FIG. 7), audible alarm generator 433 can generate an audible alarm to draw attention of anybody nearby. Depending on the programming of the electronics, including circuit board 430, etc., audible alarm generator 433 may cause an alarm until instructed to cease via infrared communication port 436. Alternatively, infrared communication port 436 may be used to disarm alarm generating functions prior to an authorized removal of EAS tag for irregular objects 400 from an object. Embodiments of EAS tag 400 using radio frequency signals for communications can accomplish the same with that medium. Light emitting diode 432 provides a supplemental visual cue along with the audible alarm created by audible alarm generator 433.

In addition to the active elements of EAS tag for irregular objects 400 shown in FIG. 6, some embodiments of EAS tag for irregular objects 400 may employ a more traditional EAS element. This EAS element 435 can be detected by an external EAS sensing system which will generate a system alarm. Some embodiments of EAS tag for irregular objects 400 that employ an EAS element may also sense the excitation within EAS element 435, and based upon that excitation, determine that EAS tag for irregular objects 400 is in an interrogation zone and generate an audible alarm with audible alarm generator 433.

Figure 7:
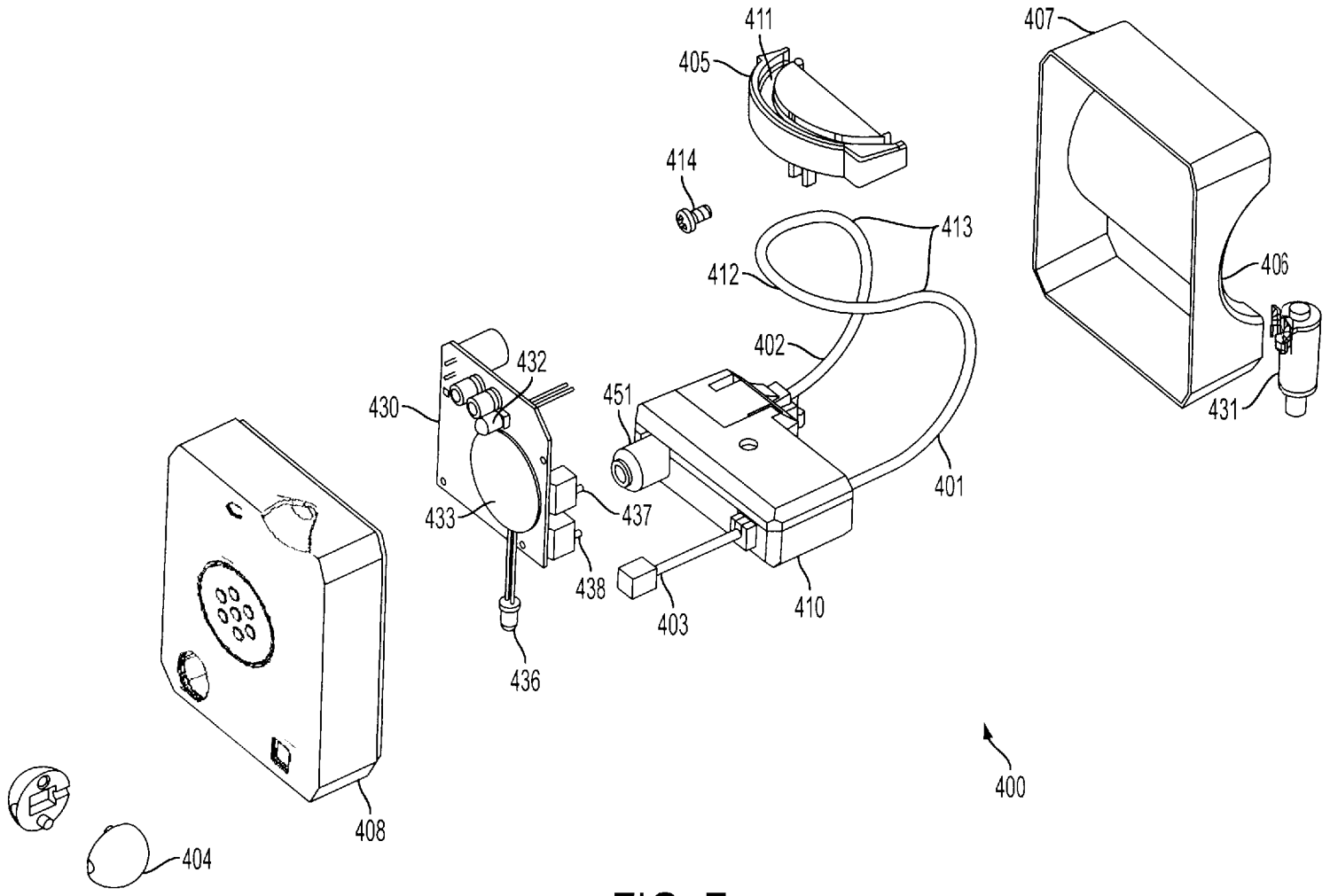
FIG. 7 is an exploded perspective view of an EAS tag for irregular objects showing the relationship of the several components.

FIG. 7 is an exploded perspective view for EAS tag for irregular objects 400. FIG. 7 shows the separation of retention half 407 of shell 423 and electronics half 408 of shell 423 and the respective components removed from those half shells. Additional features of the electronic components and the retention components of EAS tag for irregular objects 400 are visible.

With respect to retention aspects of EAS tag for irregular objects 400, mechanical housing 410 with retention cable 401 and looping anchor 405 may be seen removed from retention half 407 of shell 423. Channel 411 in looping anchor 405 may be seen. To assemble the embodiment of EAS tag for irregular objects 400 shown in FIG. 7, mechanical housing 410 and retention cable 401 are inserted up into the retention half of shell 407. Retention cable 401 is bent over and passed back through retention half of shell 407 and return loop 412 of retention cable 401 is laid into channel 411 of looping anchor 405. Looping anchor 405 with return loop 412 of retention cable 401 in place is inserted into retention half 407 of shell 423 and held in place by screw 414. This leaves retention loops 413 exposed above cradles 406. Retention loops 413 and cradles 406 may be seen more clearly in FIG. 5. Similarly, the fit of looping anchor 405 up into retention half of shell 407 can be seen in FIG. 5. The use of looping anchor 405 creates additional retention loops along the length of retention cable 401. Additional looping anchors would create additional retention loops using a single length of retention cable 401.

Referring now to FIG. 5 and FIG. 7, with respect to electronic aspects of EAS tag for irregular objects 400, anti-tamper switch 437 may be seen in FIG. 5 and FIG. 7 while activation switch 438 may be seen in FIG. 7. Anti-tamper switch 437 protrudes through an aperture in contact surface 439 generally contiguous with cradles 406 of retention half 207 of shell 423. Once EAS tag for irregular objects 400 is attached to an object, anti-tamper switch 437 is depressed and remains depressed while EAS tag for irregular objects 400 is attached to the object and contact is maintained between the object and contact surface 439. Contact surface 439 can be contoured to fit the expected shape of an object to be protected. In the embodiment shown in FIG. 5 and FIG. 7, contact surface 439 has concave cylindrical shape. If EAS tag for irregular objects 400 is removed from the object without authorization, anti-tamper switch 437 is released and the microprocessor or circuit board 430 instructs audible alarm generator 433 to generate an audible alarm. Light emitting diode 432 may also flash. Infrared communication port 436 can be used to communicate with EAS tag for irregular objects 400 to disarm an alarming tag or disarm the circuitry for an authorized removal of a tag.

Because anti-tamper switch 437 is in an exposed position, it is desirable that the tag not be set accidentally by any random contact with the tag and anti-tamper switch 437. Activation switch 438 provides an arming step for applying the tag to an object. Activation switch 438 protrudes through retention half 407 of shell 423 into a recessed area (not visible in the figures). This recess may be located in contact surface 439, and in that case means that activation switch 438 is not contacted by the object to which EAS tag for irregular objects 400 is attached, but is covered by the object. In one embodiment of EAS tag for irregular objects 400, the electronics are programmed to start a predetermined time interval when activation switch 438 is pressed. During this time interval, EAS tag for irregular objects 400 must be attached to an object and anti-tamper switch 437 depressed for EAS tag for irregular objects 400 to become armed. After EAS tag for irregular objects 400 is attached to an object, anti-tamper switch 437 is depressed, and the electronics armed. If EAS tag for irregular objects 400 is tampered with in such a way that anti-tamper switch 437 is released, then EAS tag for irregular objects 400 will determine an alarm condition. In some embodiments, EAS tag for irregular objects 400 will sound an audible alarm, and may, in some embodiments, flash light emitting diode 432. Other embodiments, may send a signal via the onboard communication elements of the electronics to the EAS system to create a system alarm. These signals may be via infrared light or radio frequency communications.

Referring now to both FIG. 7 and FIG. 5, to adjust retention cable 401, adjustable end 403 is pulled from an initial slack position and retention loops 413 adjust to a smaller size as retention cable 401 slides through channel 411 of looping anchor 405. A releasable one-way clutch in mechanical housing 410 prevents retention cable 401 from slipping back to a looser state.

Figure 8:
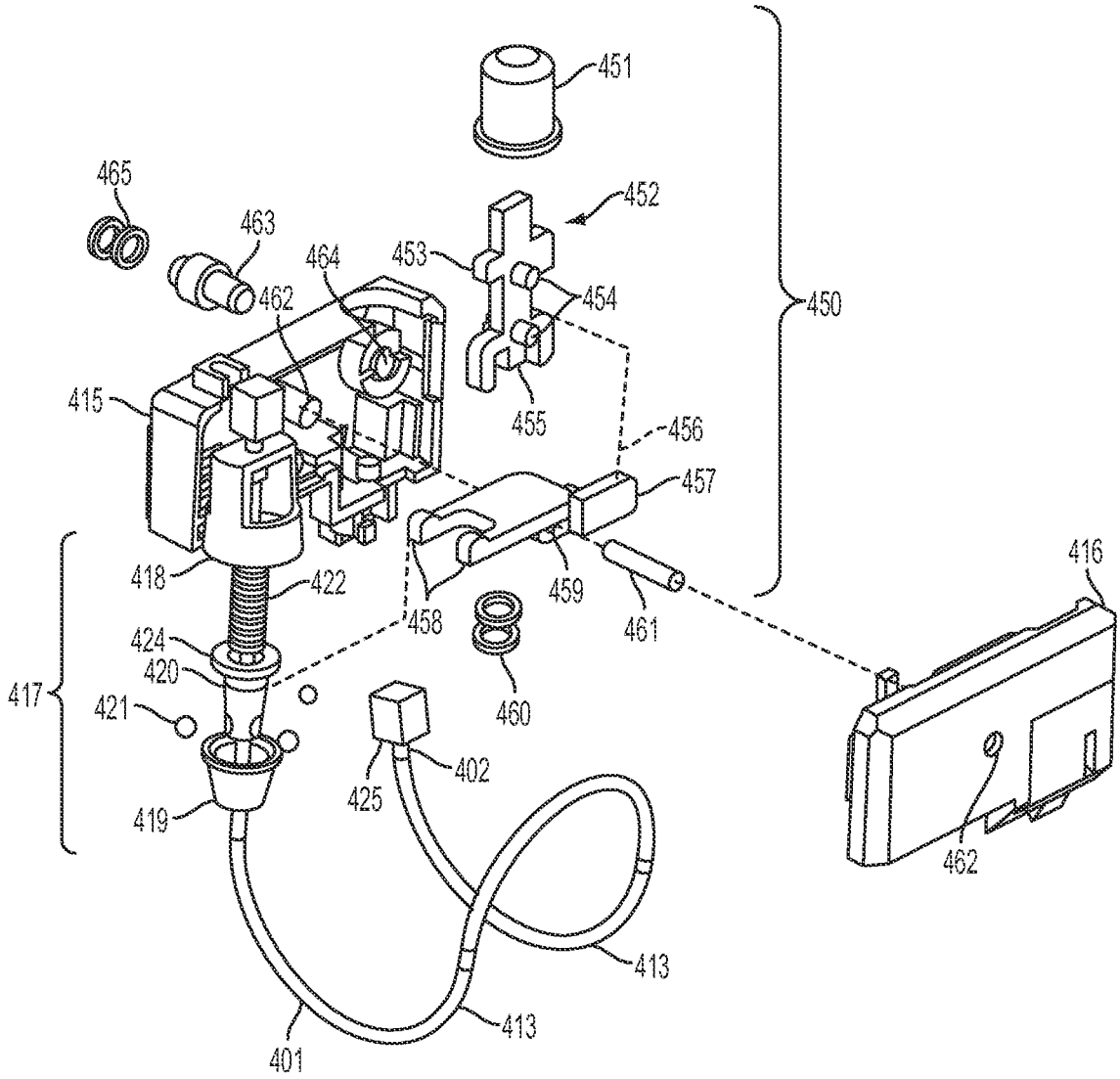
FIG. 8 is a first exploded perspective view of the housing holding the locking and release elements of an EAS tag for irregular objects.
Figure 9:
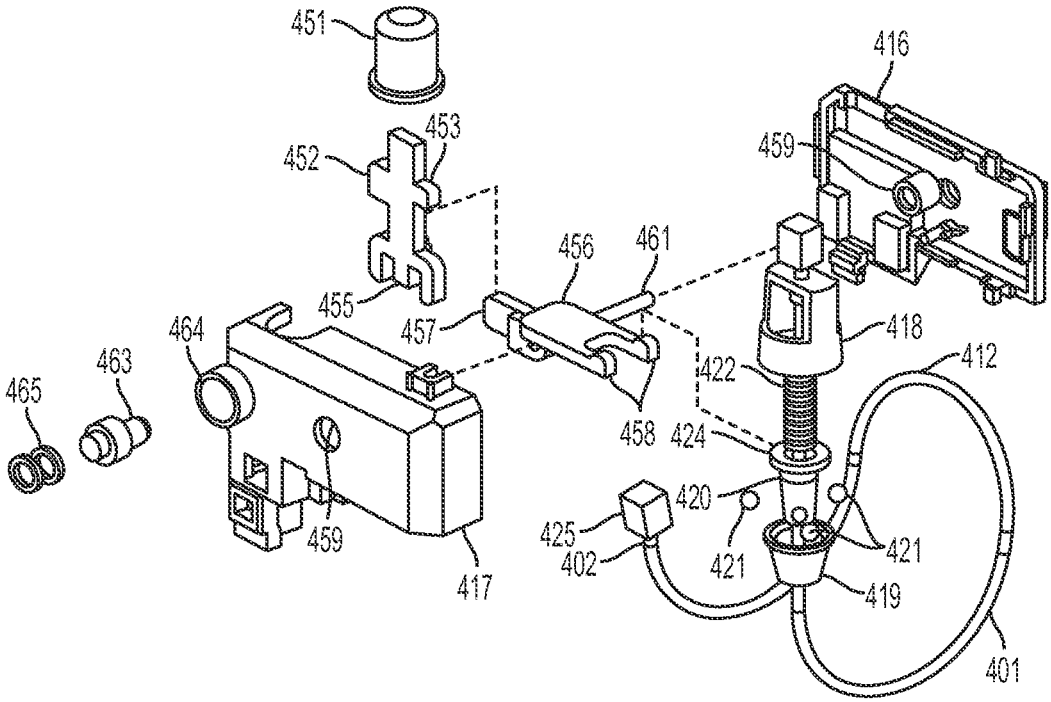
FIG. 9 is a second exploded perspective view of the housing holding the locking and release elements of an EAS tag for irregular objects.
Figure 10:
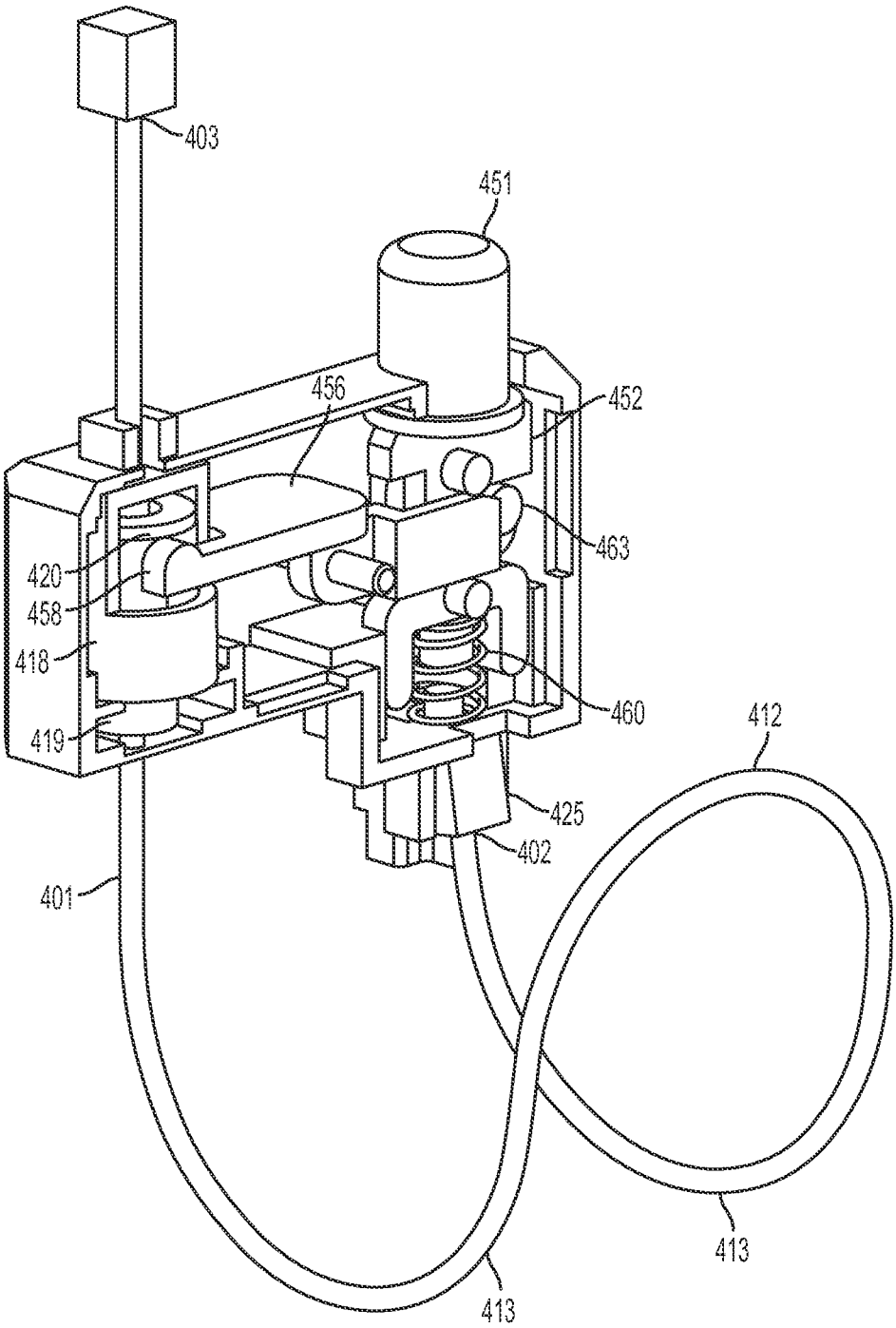
FIG. 10 is an assembled view of the locking and release elements of an EAS tag for irregular objects in their housing with the cover removed.

Referring now to FIG. 8 and FIG. 9, which are exploded perspective views of mechanical housing 410, and FIG. 10, which shows half of mechanical housing 410 with a cover plate removed, the clutching, release, and release blocking elements of EAS tag for irregular objects 400 can be seen. In FIGS. 8 and 9, mechanical housing 410 is split into a nesting half 415 and a cover plate half 416. End block 425 on fixed end 402 of retention cable 401 provides a means of clamping fixed end 402 of retention cable 401 in mechanical housing 410.

Within nesting half 415 of mechanical housing 410, a releasable ball clutch mechanism can be seen which locks retention cable 401 against attempts to relax retention cable 401. Ball clutch 417 is comprised of clutch housing 418, cup 419 with tapered profile, spindle 420, balls 421, and clutch spring 422. Retention cable 401 passes through an aperture in cup 419 and through the center of spindle 420, clutch spring 422 and clutch housing 418. Spindle 420 carries balls 421 and nests into cup 419 with tapering profile. As may more clearly be seen in FIG. 9, in some embodiments of EAS tag for irregular objects 400, spindle 420 carries three clutch balls 421. Spindle 420 maintains balls 421 in contact with retention cable 401 and cup 419 with clutch spring 422 providing a bias keeping spindle 421 biased into cup 419. If retention cable 401 is pulled at retention loops 413 to obtain a more relaxed state, retention cable 401 will pull balls 421 down into cup 419 and be wedged between the multiple balls in spindle 420. This will effectively lock retention cable 401 against any attempts to relax it. Spindle 420 has a rim 424 on its end opposite to the one that carries balls 421 and inserts into cup 419. Rim 424 of spindle 420 is used to move spindle 420 and release ball clutch 417. In the embodiment shown in FIG. 8 and FIG. 9, retention cable 401 and retention loops 413 are infinitely adjustable within the length limits of retention cable 401 and the fully tight position, allowing a wide range of objects to be accommodated. Other embodiments may provide discrete incremental adjustments for retention cable 401.

Referring to FIG. 8, the components of release mechanism 450 are shown. Release mechanism 450 acts upon ball clutch 417 to allow retention cable 401 to be adjusted to a slack position. Release mechanism 450 consists of release button 451, release driver 452, release rocker 456, return spring 460, and pivot 461. The rim of release button 451 rides on the shoulders 453 of release driver 452. Release driver 452 is generally constrained within the nesting half 415 of mechanical housing 410. On the end of release driver 452 opposite to release button 451 are spring prongs 455. Return spring 460 fits around the central one of spring prongs 455 while the outer spring prongs 455 provide further constraints on return spring 460. Return spring 460 holds release driver 452 and release button 451 in a generally upward position when release button 451 is not being depressed.

Release rocker 456 has at one end, follower arm 457, at the other end, lift prongs 458, and in the center, pivot aperture 459. Release rocker 456 is mounted by pivot aperture 459 on pivot 461 which has its ends inserted into pivot apertures 462 in nesting half 415 and cover plate half 416 of mechanical housing 410. Follower arm 457 of release rocker 456 fits between cam pins 454 on release driver 452. Cam pins 454 on release driver 452 fit on both sides of follower arm 457 of release rocker 456 and can therefore move release rocker 456 in both directions as release driver 452 moves up and down. Lift prongs 458 of release rocker 456 engage spindle 420 of ball clutch 417 under rim 424. As release button 451 is pressed, release driver 452 transfers the motion into follower arm 457. This causes follower arm 457 to also move downward and lift prongs 458 on the opposing end of release rocker 456 to move upward. This lifts spindle 420 in ball clutch 417. As spindle 420 is lifted from cup 419, balls 421 are moved to a position within cup 419 where there is space between retention cable 401, clutch balls 421, and cup 419, removing the wedging effect created between those elements.

To prevent the unauthorized release of retention cable 401, blocking pin 463 protrudes through locking pin aperture 464 and blocking pin 463 protrudes below one of shoulders 453 on release driver 452. Blocking spring 465 biases blocking pin 463 into an extended position where it keeps release driver 452 from being moved downward to release ball clutch 417. At least some part of blocking pin 463 is magnetically attractable and the application of a magnet to nesting half 415 of mechanical housing 410 over blocking pin 463 will retract blocking pin 463 from its locking position under one of shoulders 453 on release driver 452. This will allow the depression of release button 451 to actuate the release of ball clutch 417 and allow retention cable 401 to be pulled to a relaxed position.

As an example of use of EAS tag for irregular objects 400, an application of EAS tag for irregular objects 400 with respect to a fishing pole will be described. While generally cylindrical, handles for fishing poles may have a somewhat irregular contour. This creates challenges for EAS tags designed to affix to a smooth and predictable contour. To arm and attach EAS tag for irregular objects 400 to a fishing pole, a magnet may be used to withdraw blocking pin 463 from beneath shoulder 453 of release driver 452, so that ball clutch 417 may be released and retention cable 401 may be adjusted out to a sufficiently relaxed and accommodating length. Then activation switch 438 may be pressed, so that a predetermined time period starts, and EAS tag for irregular objects 400 may be put into place against the handle of a fishing pole, depressing anti-tamper switch 437 within that predetermined time period. Once EAS tag for irregular objects 400 is in place and anti-tamper switch 437 is depressed, retention cable 401 can be adjusted to a snug fit by pulling on pull knob 404 on adjustable end 403 of retention cable 401. Retention cable 401 adjusts through looping anchor 405 so that both retention loops 413 are pulled down onto the handle and ball clutch 417 maintains retention cable 401 in the tightened state. Now EAS tag for irregular objects 400 is attached to the fishing pole handle and is armed.

Some embodiments of EAS tag for irregular objects 400 require an authorized user to use a detacher specifically made to release EAS tag for irregular objects 400 from an object being protected. Referring back to FIG. 3 and FIG. 4 detacher unit 34 is shown and detacher unit 34 is made specifically for the purpose of allowing EAS tag for irregular objects 400 to be removed from objects. Detacher unit 34 has a magnet 37 and an infrared communication port 35. The detacher unit 34 is brought into proximity to EAS tag for irregular objects 400, or vice versa, in such a way that infrared communication port 35 of detacher unit 34 can communicate with infrared communication port 436 of EAS tag for irregular objects 400 and disarm or reprogram the circuitry while magnet 37 is brought into proximity of blocking pin 463, retracting blocking pin 463. With the circuitry of EAS tag for irregular objects 400 reprogrammed or disarmed, and blocking pin 463 withdrawn from its blocking position, release button 451 may be depressed and ball clutch 417 released. Retention cable 401 may then be pulled to a more relaxed and accommodating state and EAS tag for irregular objects 400 removed from the handle of the fishing pole without triggering an alarm.

While the above example discussed a fishing pole, EAS tag for irregular objects 400 can be attached to other irregular objects. Any object that provides a contour about which retention cable 401 could be placed and tightened while keeping anti-tamper switch 437 depressed, can be protected by EAS tag for irregular objects 400. Other items include baseball bats, golf clubs, tools, etc.

In other embodiments of EAS tag for irregular objects 400, shell 423 may contain breakable ink vials. If EAS tag for irregular objects 400 is tampered with and shell 423 sufficient strained, the breakable ink vials will be broken, spilling ink onto the object being protected, and giving visual indication of the tampering. Shell 423 provides several spaces for location of the ink vials.

Although specific embodiments of the invention have been described with specificity, the embodiments described should no be considered exhaustive of the possible embodiments of the invention and should not be held as limiting the scope and range of the claims. Similarly the drawings are not exhaustive depictions of embodiments of the invention and the abstract is intended to allow a person to quickly gain the general field of the invention and should not be taken as limiting the scope of the claims.

I claim:

1. An electronic article surveillance tag comprising:

a housing;

a releasable one-way clutch located within said housing;

an adjustable retention cable passing through said releasable one-way clutch and having a a fixed end fixed to said housing and a free end, said retention cable forming at least one retention loop between said fixed end and said releasable one-way clutch;

a blocking mechanism located within said housing, said blocking mechanism preventing the release of said releasable one-way clutch; and, electronics located within said housing;

wherein, when not released, said releasable one-way clutch only allows said at least one retention loop to be shortened.

2. The electronic article surveillance tag of claim 1, further comprising:

at least one looping anchor attached to said housing and having at least one aperture, said retention cable passing through said at least one looping anchor at a location along the length of said retention cable intermediate of said fixed end and said releasable one-way clutch, a retention loop being added to said retention cable each time said retention cable passes through a said looping anchor.

3. The electronic article surveillance tag of claim 1, wherein:

said releasable one-way clutch comprises;

a tapered cup tapering from a larger open end to a smaller closed end, said closed end of said tapered cup being seated in said housing and having a cable aperture for passage of said cable;

a spindle located in said tapered cup and having a large end and a small end to generally match the taper of said tapered cup, said spindle having a hollow central shaft sized to allow passage of said cable and a set of coplanar apertures passing from said hollow central shaft to the exterior surface of said spindle, the plane of said coplanar apertures being within said tapered cup and perpendicular to the axis of said spindle, a ball located within each said aperture;

a spring having one end seated in said housing and the other end seated against said large end of said spindle and biasing said spindle into said tapered cup, and;

a release feature engageable by a releasing mechanism.

4. The electronic article surveillance tag of claim 3, wherein:

said large end of said spindle extends out of said tapered cup and said release feature is a rim around said large end, and;

said releasing mechanism is a manually operated rocker arm located in said housing and pivotally coupled to said housing, said rocker arm having at one end at least one prong engaging said rim.

5. The electronic article surveillance tag of claim 1, wherein:

said blocking mechanism can be changed to a non-blocking state by application of a magnet in proximity to said housing.

6. The electronic article surveillance tag of claim 1, wherein:

said electronics comprise a circuit board, a microprocessor, communication elements, an audible alarm generator, and a battery.

7. The electronic article surveillance tag of claim 6, further comprising:

an anti-tamper switch located within said housing and in communication with said circuit board;

an aperture through said housing, said anti-tamper switch extending through said aperture to contact an object to be protected when the electronic article surveillance tag is attached to the object to be protected.

8. The electronic article surveillance tag of claim 7, further comprising:

a recess in said contact surface;

an activation switch aperture through the surface of said recess, and;

an activation switch located in said housing and extending through said activation switch aperture, said activation switch being in communication with said circuit board and being manually actuated to activate said electronics for installation of the electronic article surveillance tag on an object to be protected.

9. The electronic article surveillance tag of claim 6, wherein:

said communication elements comprise an infrared communication port.

10. The electronic article surveillance tag of claim 6, wherein:

said communication elements comprise radio frequency communication circuits.

11. The electronic article surveillance tag of claim 7, wherein;

when said anti-tamper switch detects that an object to be protected has been removed from said contact surface without authorization being communicated to said communication elements, said electronics determine an alarm condition and generate an alarm.

12. The electronic article surveillance tag of claim 11, wherein;

said alarm is an audible alarm from said audible alarm generator.

13. The electronic article surveillance tag of claim 11, wherein;

said alarm is an alarm signal transmitted by said communication elements.

14. The electronic article surveillance tag of claim 11, further comprising:

machine readable instructions encoded in said microprocessor for storing a passcode, and, wherein;

said communication of said authorization requires communication of said passcode.

15. The electronic article surveillance tag of claim 14, wherein:

said electronics further comprise an accurate clock generator, and said machine readable instructions further comprise an algorithm for generating multiple passcodes, wherein at specific time intervals said algorithm generates a new passcode and a previously stored passcode is replaced by said new passcode.

16. The electronic article surveillance tag of claim 1, wherein:

said electronics comprise a passive electronic article surveillance element.

17. The electronic article surveillance tag of claim 1, further comprising:

a contact surface on said housing, said contact surface being proximate to said at least one retention loop, the electronic article surveillance tag being capable of retaining an object to be protected between said at least one retention loop and said contact surface.

18. The electronic article surveillance tag of claim 17, wherein:

said contact surface is contoured to conform to the expected shape of an object to be protected.

* * * * *